US009273930B2

(12) United States Patent
Jiminez et al.

(10) Patent No.: US 9,273,930 B2
(45) Date of Patent: Mar. 1, 2016

(54) SINGLE MOUNT FOR ATTACHING ACCESSORIES TO A PICATINNY TYPE RAIL OF A HAND GUN

(71) Applicants: Ivan Jiminez, Wayne, MI (US); Irving N. Rubin, Wayne, MI (US)

(72) Inventors: Ivan Jiminez, Wayne, MI (US); Irving N. Rubin, Wayne, MI (US)

( * ) Notice: Subject to any disclaimer, the term of this patent is extended or adjusted under 35 U.S.C. 154(b) by 52 days.

(21) Appl. No.: 13/694,486

(22) Filed: Dec. 6, 2012

(65) Prior Publication Data

US 2014/0157644 A1 Jun. 12, 2014

(51) Int. Cl.
*F41A 15/00* (2006.01)
*F41G 11/00* (2006.01)

(52) U.S. Cl.
CPC ..... *F41G 11/003* (2013.01)

(58) Field of Classification Search
CPC ..... F41A 35/00
USPC ..... 42/90, 124, 127
See application file for complete search history.

(56) References Cited

U.S. PATENT DOCUMENTS

| | | | | |
|---|---|---|---|---|
| 7,669,359 | B2 * | 3/2010 | Kim | 42/124 |
| 8,727,556 | B2 * | 5/2014 | Swan | 362/103 |
| 2010/0154276 | A1 * | 6/2010 | Kim | 42/90 |
| 2010/0263255 | A1 * | 10/2010 | Harris | 42/90 |
| 2014/0096429 | A1 * | 4/2014 | Sandler et al. | 42/124 |

* cited by examiner

*Primary Examiner* — J. Woodrow Eldred
(74) *Attorney, Agent, or Firm* — Alex Rhodes

(57) ABSTRACT

A single mount for mounting a group of accessories on a hand gun, comprising: a four sided bracket for slideably engaging the mount with a Picatinny rail of the hand gun and attaching accessories above, below and to the sides of the hand gun. The mount has a pair of V-grooves in a bottom portion for slideably engaging a pair of V-slides of the hand gun and at least one outward extending Picatinny type rail portions for attaching an accessory to the hand gun. An upper portion of the bracket is spaced upwardly away from a barrel of the hand gun by a distance which allows a shooter to view an existing iron sight at the front of the hand gun. The short Picatinny type rail portion has a cross groove which cooperates with a cross-bolt to lock an accessory on the mount.

17 Claims, 6 Drawing Sheets

SINGLE MOUNT FOR ATTACHING ACCESSORIES TO A PICATINNY TYPE RAIL OF A HAND GUN

FIELD OF THE INVENTION

This invention relates to fire arms and more particularly to a mount for mounting multiple accessories on a Picatinny rail of a hand gun.

BACKGROUND OF THE INVENTION

The telescopic sight (herein referred to as a "telescope") is the most popular hand gun accessory. The Picatinny rail, also known as the MIL-STD-1913 rail, was developed at a government arsenal to provide a standard platform for mounting the telescopic sight on large caliber military rifles.

The Picatinny and similar rails have been added to the undersides of hand guns for mounting telescopic sights. A need exists for a single mount for combining the telescopic and other accessories, such as, night vision devices, laser pointers and flashlights on revolvers and semi-automatic hand guns. An optimum single mount would engage a Picatinny type type rail which is a simple and precise means for engaging an accessory.

The Picatinny rail is a double V-slide rail which is divided by transverse spaced apart 0.206 wide grooves on 0.394 centers. The grooves form a series of T-shaped cross-section ridges separated by evenly spaced apart grooves. An accessory is mounted on the rail by slideably engaging the V-slide of the Picatinny rail with the V-grooves of the accessory. A similar rail, known as the Weaver rail is marketed for civilian rifles and hand guns.

The weight of an ideal mount should be low. It should not block a shooter's view of an existing iron sight but should allow for hand gun and accessory differences and not affect the balance of a hand gun.

SUMMARY OF THE INVENTION

A primary object of the invention is to provide a single compact mount for mounting accessories on firearms. Another object is to provide a single mount that would engage a Picatinny or similar rail. Another object is to provide a single mount for accessories on hand guns that does not block a shooters' views of an iron sight. Another object is to maintain the balance of weight on hand guns with accessories.

With the foregoing objects in mind, a single compact mount is provided for combining several accessories on a Picatinny type rail of a revolver or semi-automatic hand gun. The single mount is comprised of a bracket having a pair of double v-grooves for slideably engaging the V-slides of a Picatinny or similar rail, slender side portions for connecting the upper and lower portions and short outward extending Picatinny type rail portions for attaching accessories One benefit of the mount is low weight. Another benefit is that it allows a shooter to view an iron sight.

In employing the teaching of the present invention, alternate constructions can be adopted to achieve the desired results and capabilities. In this disclosure, although several embodiments are disclosed, the disclosed embodiments are intended as examples only and should not be considered as limiting the scope of the invention.

Further features and benefits will be apparent by reference to the drawings and ensuing detailed description of a preferred embodiment which discloses the best mode contemplated in carrying out the invention. The exclusive rights which are claimed are set forth in the numbered claims following the detailed description of the preferred embodiment.

BRIEF DESCRIPTION OF THE DRAWINGS

The invention will be better understood and further objects, characterizing features, details and advantages thereof will appear more clearly with reference to the diagrammatic drawings illustrating preferred features of the invention by way of non-limiting examples only.

DESCRIPTION OF A PREFERRED EMBODIMENT

Figure 1:
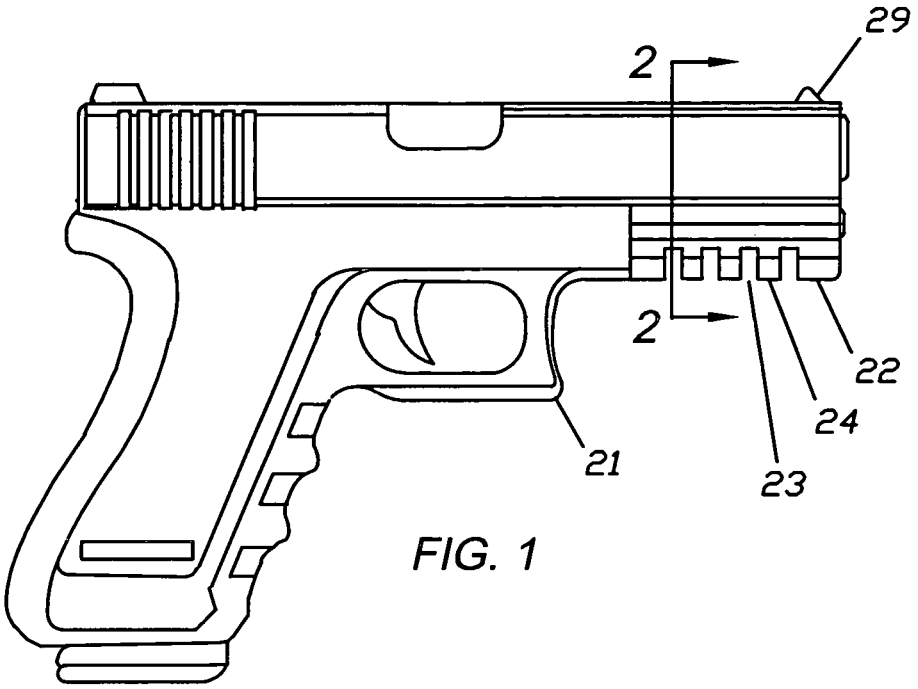
FIG. 1 is a side view of a hand gun with a Picatinny rail.
Figure 2:
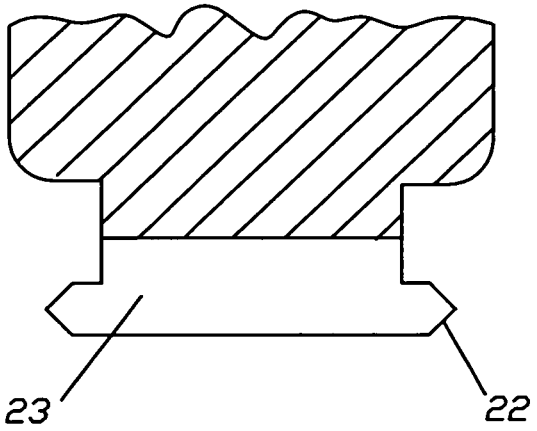
FIG. 2 is an enlarged cross-sectional view taken on the line 2-2 in FIG. 1.

Referring now to the drawings wherein like numerals designate like and corresponding parts throughout the several views, in FIGS. 1 and 2 a hand gun 21 is shown having a Picatinny rail 22 on an underside of the hand gun 21. The Picatinny rail 22 is a double V-slide rail with equally spaced transverse grooves 23 that divide the rail into ridges 24, separated by the spaced apart grooves 23.

Figure 3:
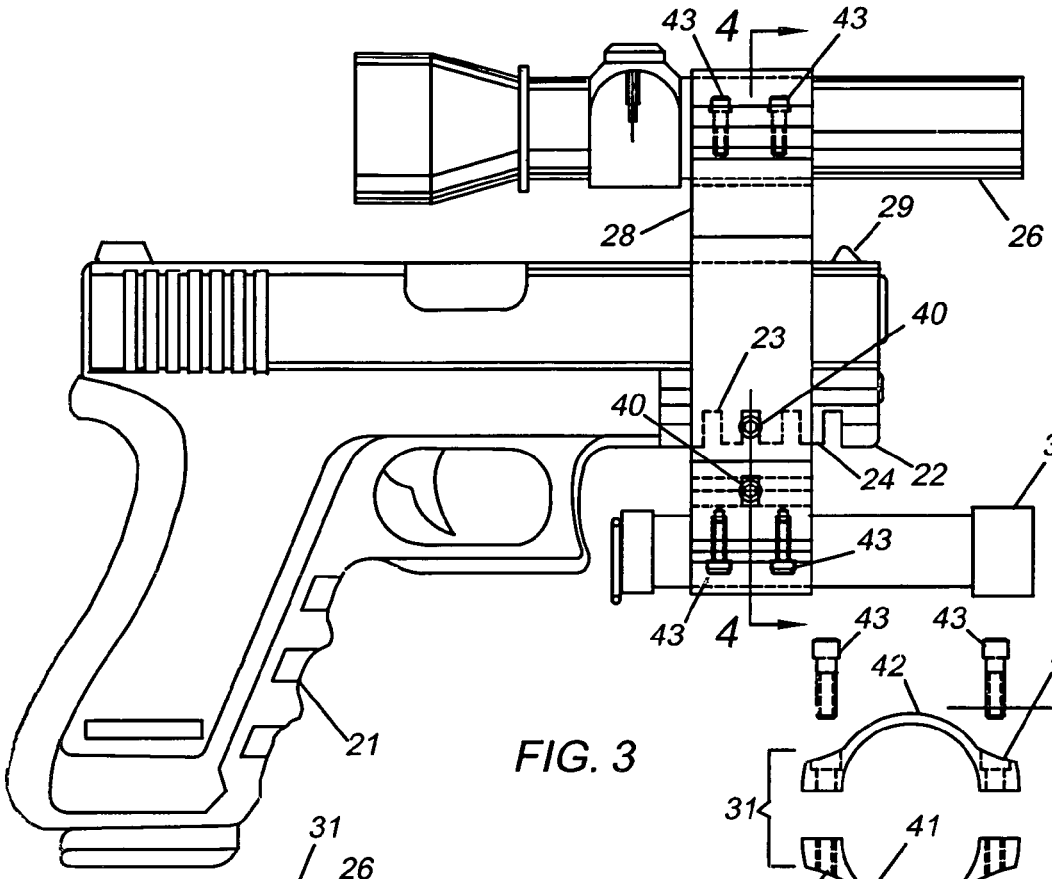
FIG. 3 is a side view of a hand gun with a telescope and flashlight.
Figure 4:
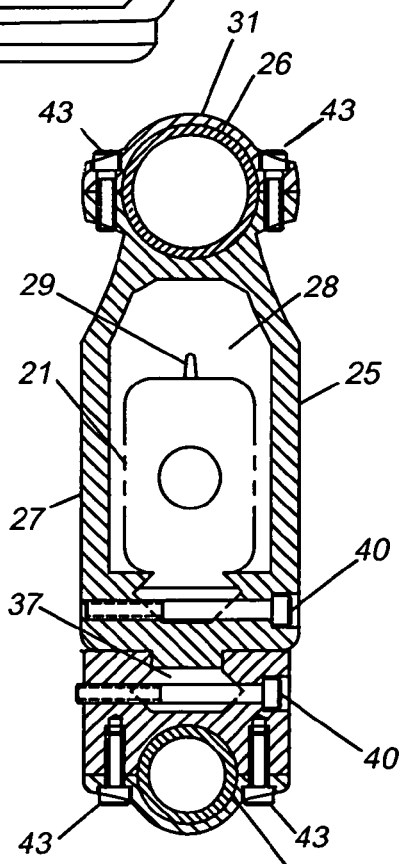
FIG. 4 is a cross-sectional view taken on the line 4-4 in FIG. 3.
Figure 5:
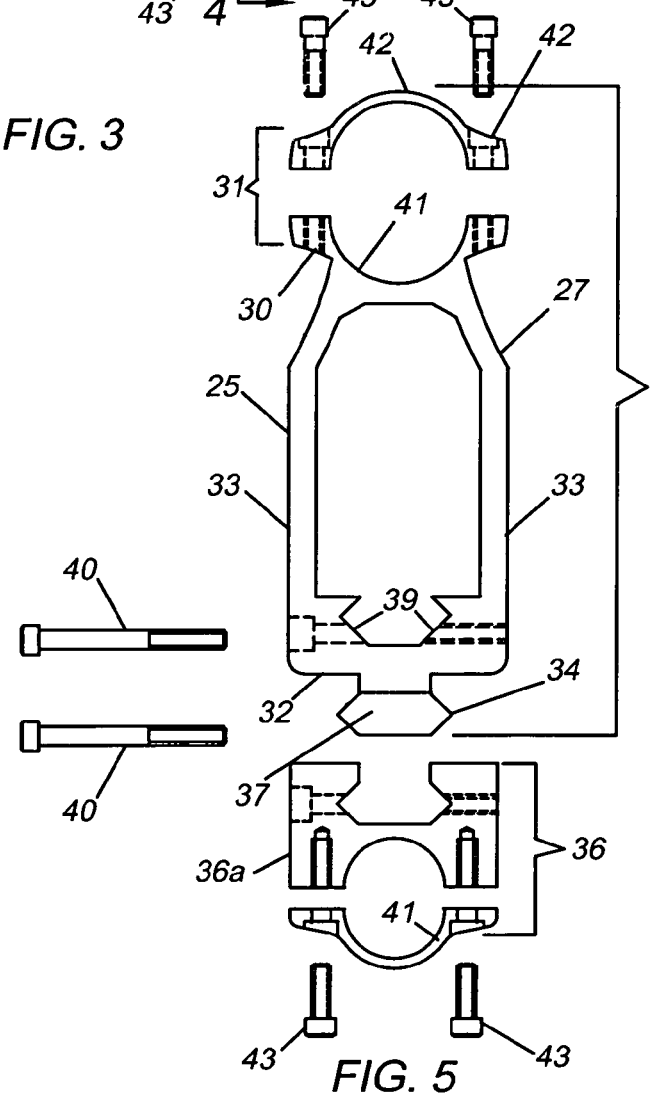
FIG. 5 is an exploded front view.
Figure 6:
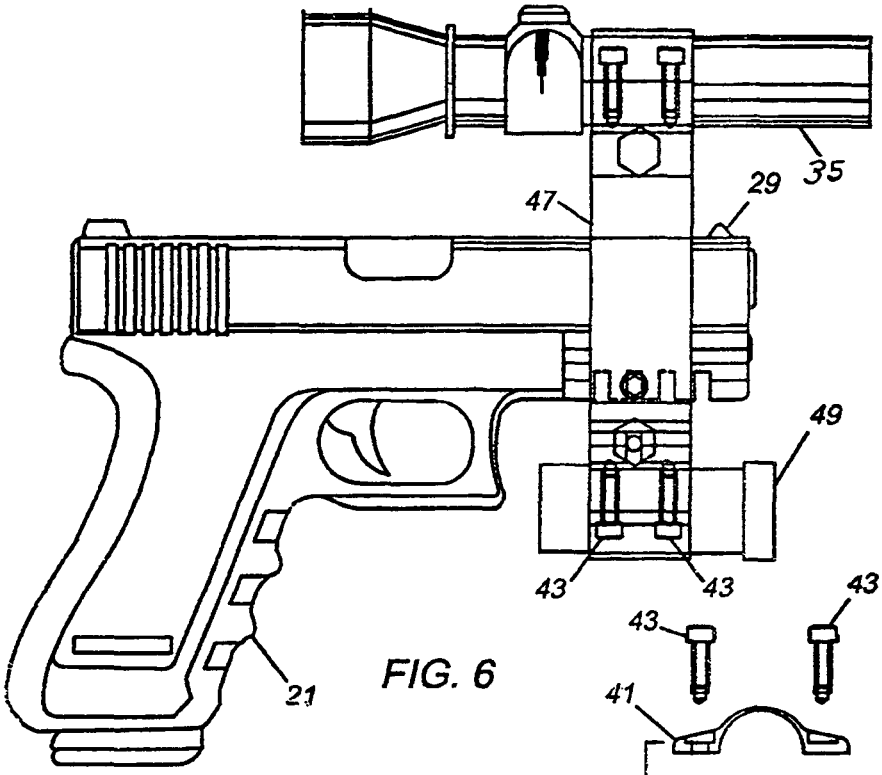
FIG. 6 is a side view of a gun with a telescope and laser pointer.
Figure 7:
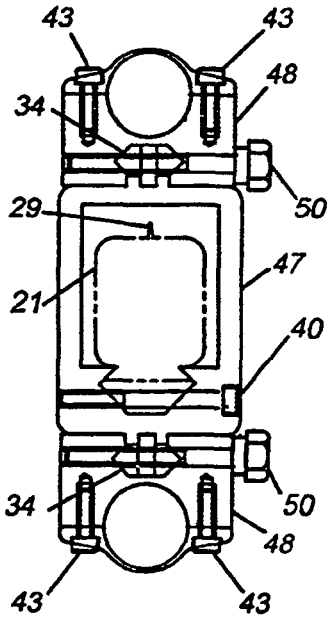
FIG. 7 is a front view of the mount in FIG. 6.
Figure 8:
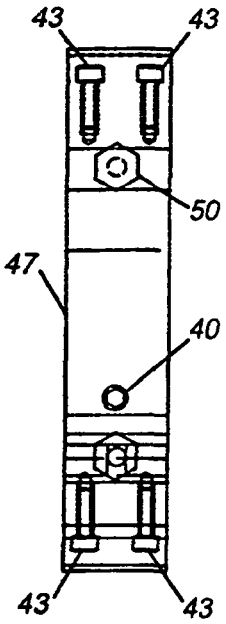
FIG. 8 is a side view of FIG. 6.
Figure 9:
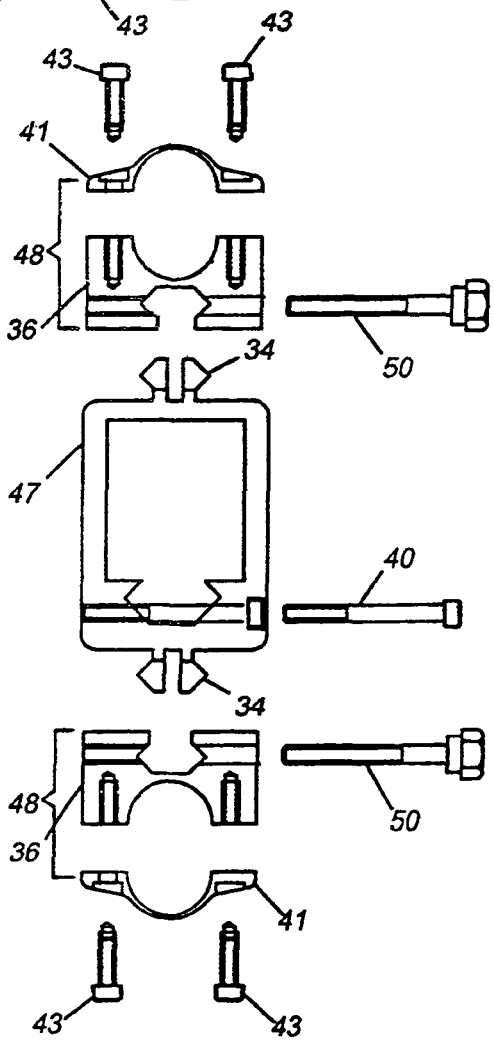
FIG. 9 is an exploded front view of the mount in FIG. 6.
Figure 10:
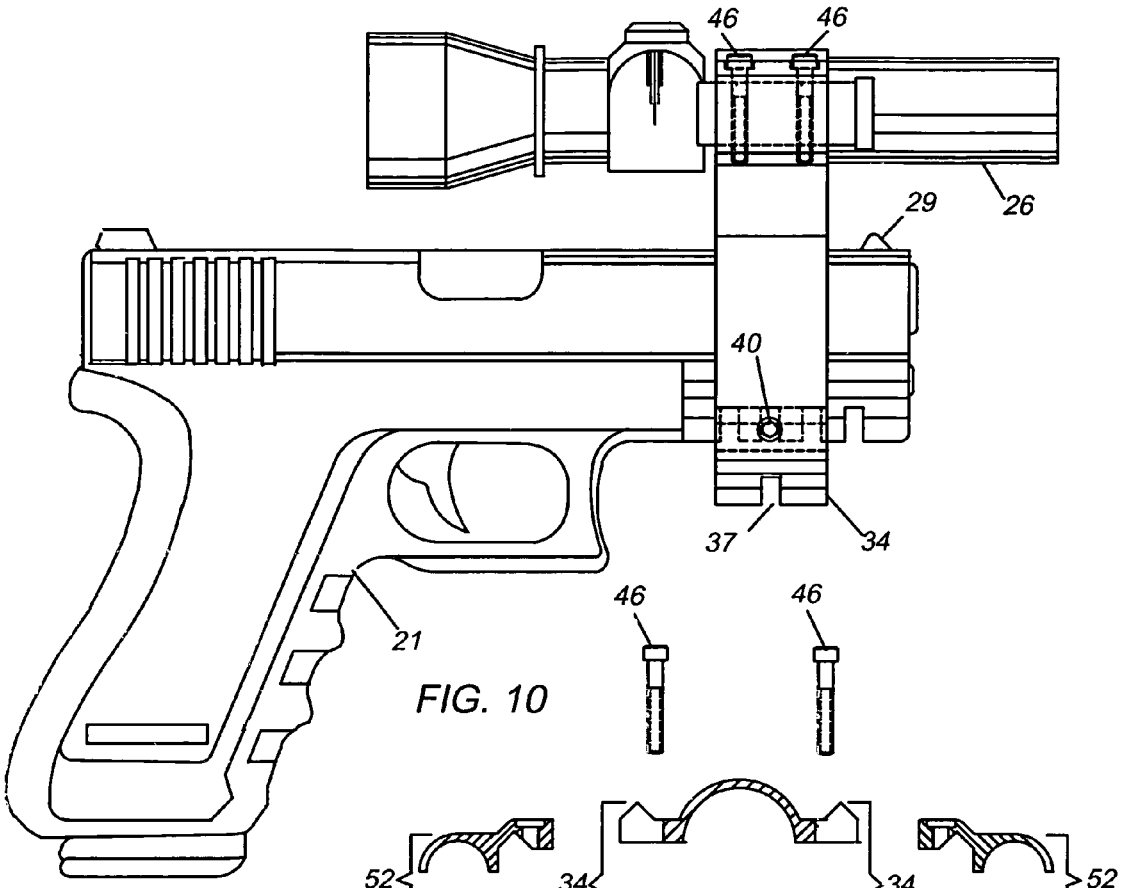
FIG. 10 is a side view of a mount with a three accessory rings.
Figure 11:
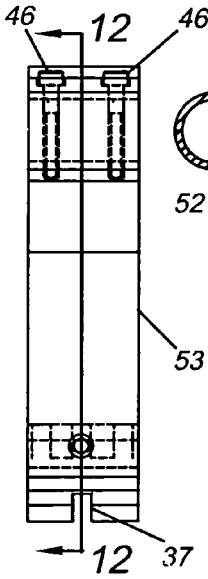
FIG. 11 is a side view the mount in FIG. 10.
Figure 12:
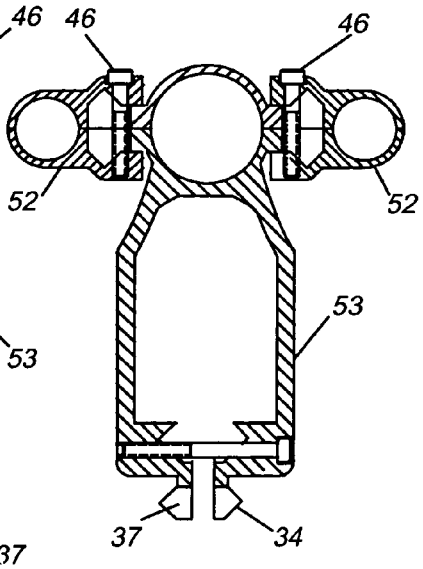
FIG. 12 is a cross-sectional view taken on the line 12-12 in FIG. 11.
Figure 13:
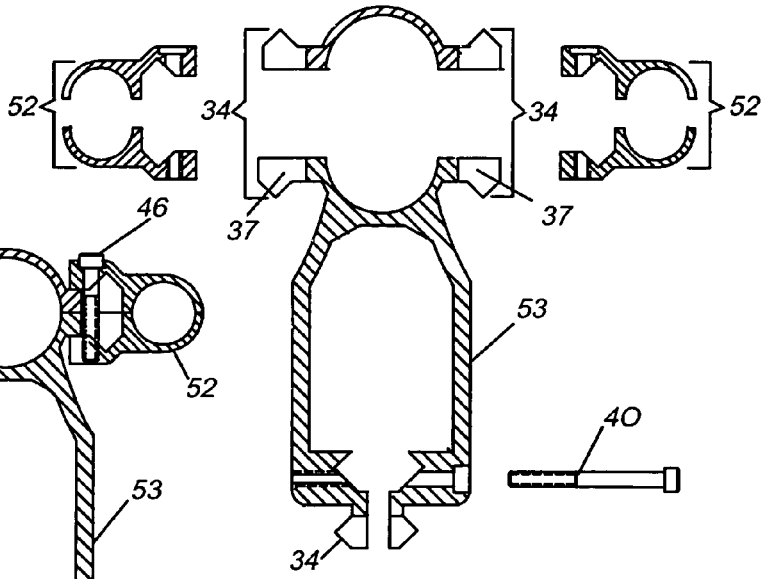
FIG. 13 is an exploded FIG. 12 cross-sectional view.
Figure 14:
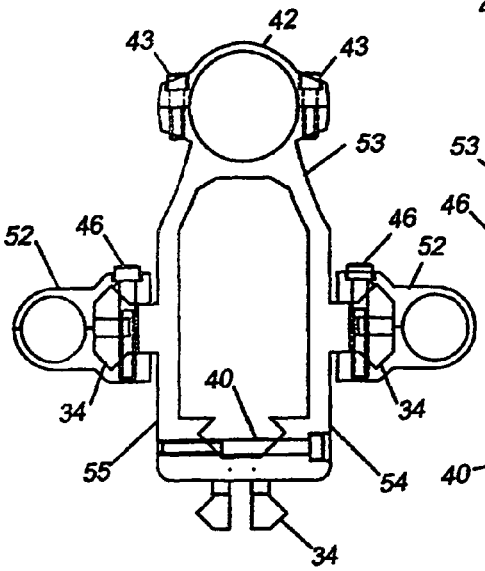
FIG. 14 is a front view of an alternate embodiment of a mount with three accessory rings.
Figure 15:
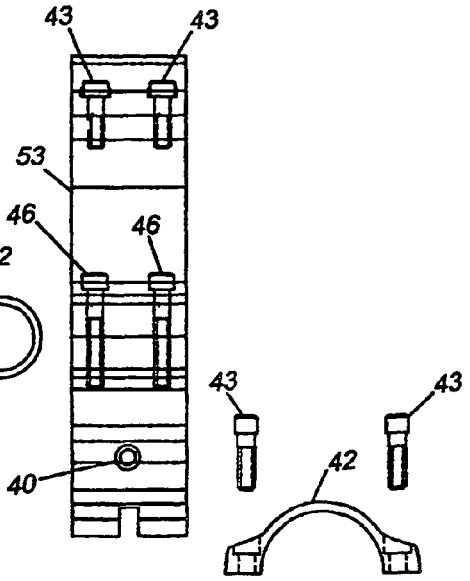
FIG. 15 is a side view of the mount in FIG. 14.

In FIGS. 3 through 5, a telescopic sight 26 (hereinafter referred to as a "telescope") and flashlight 35 are mounted on a hand gun 21. The telescope 26 is spaced above a barrel of the hand gun 21 by an amount which forms a "window" 28 though which an iron sight 29 may be used as a back-up sight. The mount 25 is comprised of a bracket 27 having an upper portion 30, a lower portion 32 which slideably engages a Picatinny rail 22 of the hand gun 21, a pair of slender spaced apart side portions 33 which connect the upper 27 and lower portions 32 and a short downward extending short Picatinny type rail portion 34 which slideably engages an accessory ring 36 for mounting the flashlight 35.

The "Picatinny type rail" 34 is a double V-slide rail that is similar to the MIL-STD-1913 rail. The upper portion 30 of the bracket 27 serves as a saddle 41 of an accessory ring 31 for mounting the telescope 35. A detachable cap 42 is clamped to the saddle 41 with two pairs of cap screws 43. One benefit of the four sided bracket 27 which surrounds the hand gun is that it can be used for mounting accessories above below and at the sides of the hand gun 21.

The manner of attaching the flashlight 35 to the gun 21 can be understood by reference to FIG. 4. The laser pointer accessory ring 36 is attached to the bracket 27 with two pairs of cap screws 43. The short downward Picatinny type rail 34 includes a cross groove 37 through which a threaded fastener 40 passes to lock the accessory ring 36 on the mount 25. With reference to FIG. 4, double V-grooves 39 in the lower portion 32 of the mount 25 engage the Picatinny rail 22 of the gun 21.

The accessory ring 36 at the bottom of the mount 25 which supports the flashlight 35 consists of a detachable saddle 36*a* and a cap 42. Two pairs of cap screws 43 clamp the cap 42 on the saddle 36. The accessory ring 36 slideably engages the short Picatinny type rail 34 which extends downwardly from the mount. The bracket 27, upper 3 land lower 36 accessory rings are shown separately in the exploded view of FIG. 5. In the remaining similar single mounts are shown with accessories at alternate positions around the mounts.

In FIGS. 6 through 9, a mount 47 is shown in which short Picatinny type rails 34 extend upwardly from a top and downwardly from a bottom of the mount 47. A telescope 35 is mounted in an accessory ring 48 that slideably engages the short upper rail 34 and a laser pointer 49 is shown mounted in an accessory ring 48 which sideably engages the short lower rail 34. The accessory rings 48 are locked in the mount 47 with shoulder screws 50. The accessory rings 48 and mount 47 are separately shown in the exploded view of FIG. 9. One benefit of this embodiment is that the laser pointer 49 can be moved upward to replace the telescope 26 and the telescope 26 can be replaced with another device, such as a night vision device (not shown) or a flashlight 35.

In FIGS. 10 through 13, inclusive, a single mount 53 is shown in which a pair of accessory rings 52 extend outwardly at the same the level as a telescope 26. One benefit of this embodiment 51 is that devices, such as laser pointers 49 and night vision devices can be viewed by only sideway movement of an eye. The accessory rings 52 and mount 51 are separately shown in the exploded view of FIG. 13.

Figure 16:
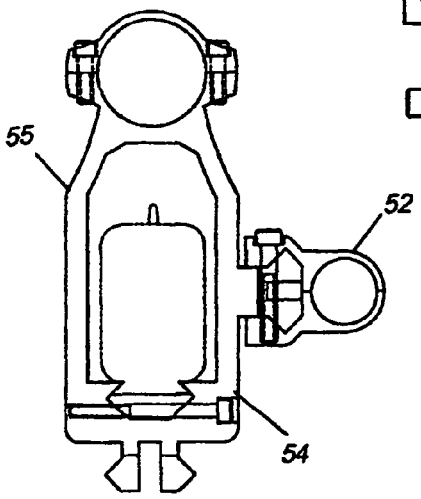
FIG. 16 is a front view of a mount with a pair of accessory rings.
Figure 17:
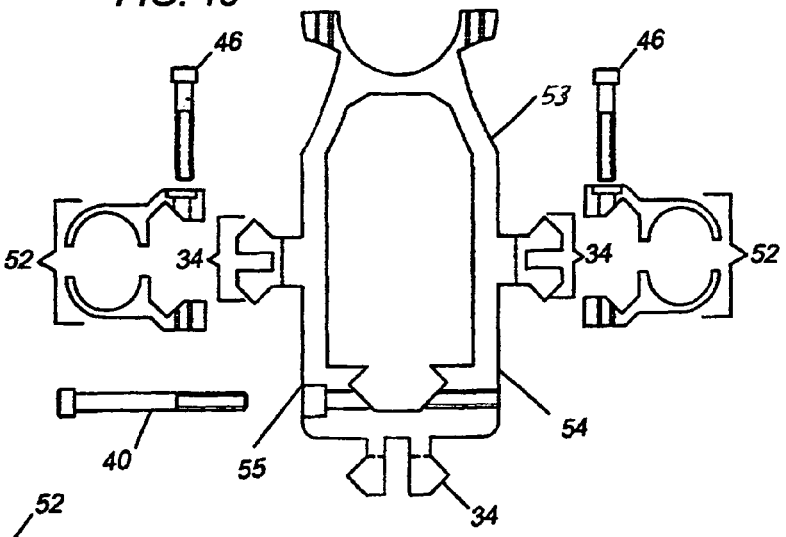
FIG. 17 is an exploded front view of the mount in FIG. 14.

In FIGS. 14 through 17 inclusive, a single mount 53 is shown wherein a pair of accessory rings 52, attached to short Picatinny type rails 34, extend outwardly from opposite sides 54, 55 of the mount 53. In FIG. 16 a single accessory ring 52 extends outwardly from one side 54 of the mount 53. The pair of accessory rings 52 and single mount 53 are shown separately in the exploded view of FIG. 17.

Figure 18:
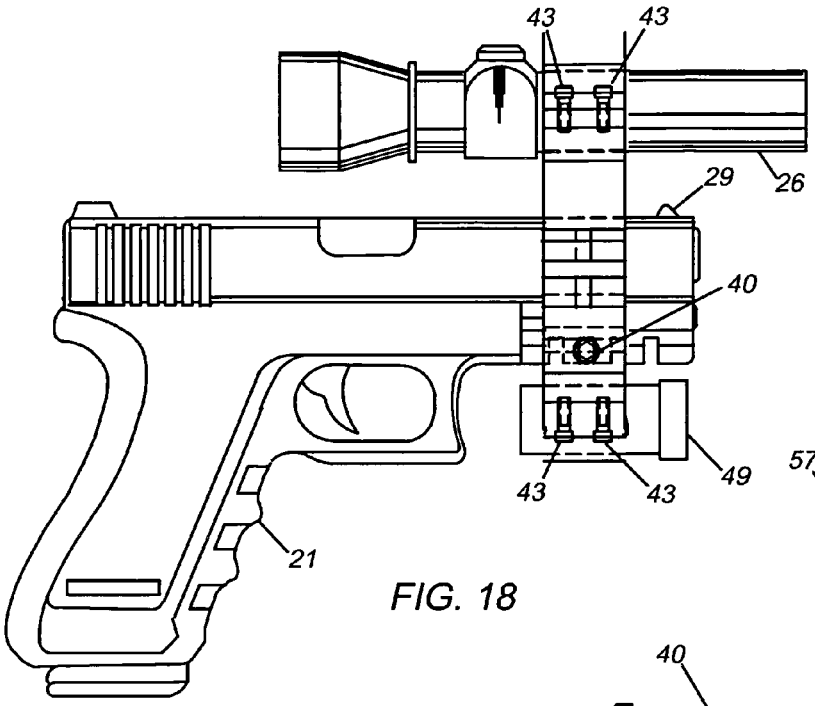
FIG. 18 is a side view of a gun with a mount and a pair of accessory rings.
Figure 21:
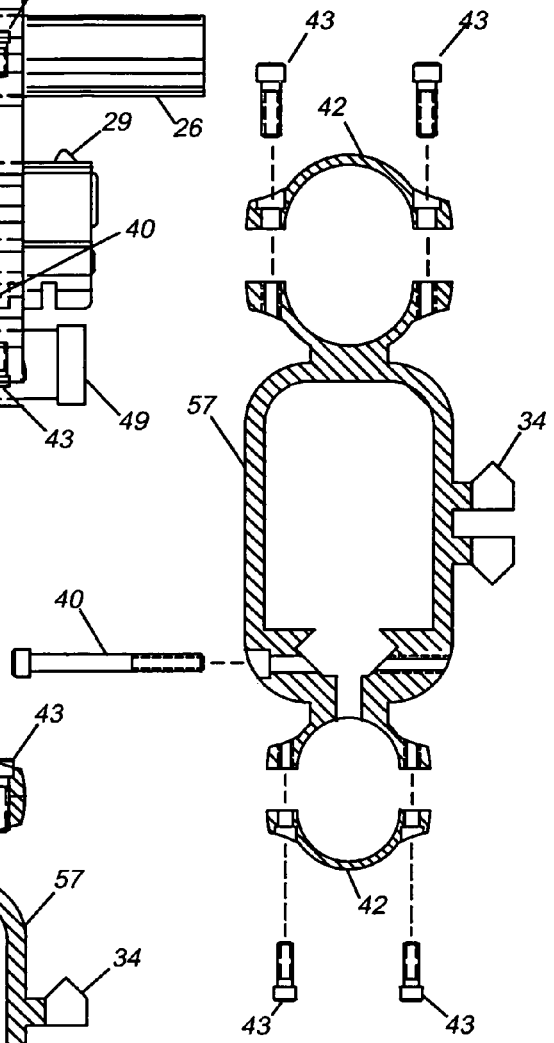
FIG. 21 is an exploded FIG. 20 cross-sectional view.
Figure 19:
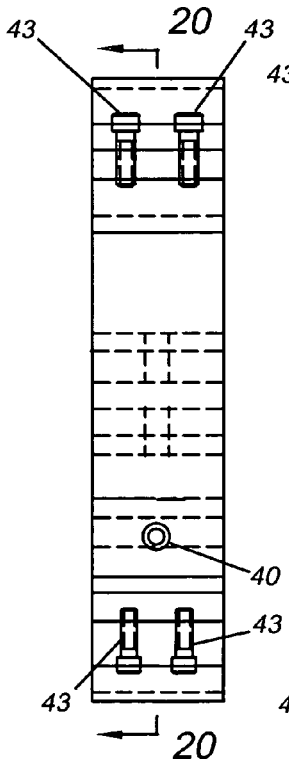
FIG. 19 is a side view of the mount in Fig.
Figure 20:
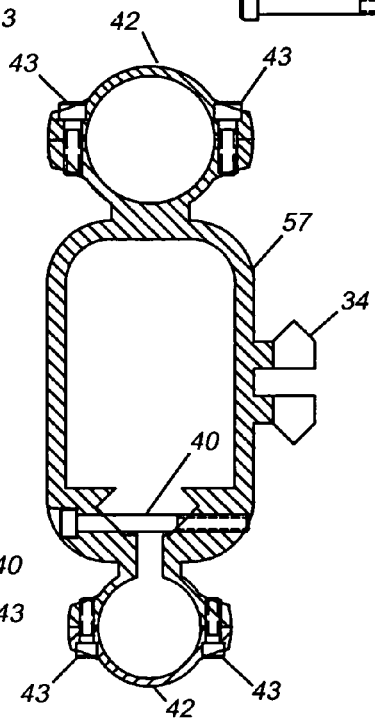
FIG. 20 is a cross-sectional view taken on the line 20-20 in FIG. 19.

In FIGS. 18 through 20, a single mount 57 is shown wherein a pair of accessory rings 58, 59 extend upwardly and downwardly from a top and bottom of the mount 57. One benefit of this embodiment is reduced weight.

From the above, it is apparent that our invention provides numerous benefits in the relevant art. Our invention is a single compact easy to use mount for mounting multiple accessories on a hand gun. It further allows a gun owner to quickly re-position accessories of a gun without replacing a mount. For example, a laser pointer which is below the barrel of a hand gun to quickly replace a telescope which is positioned above the gun without replacing a mount. It also allows a gun owner to quickly replace accessories on a gun, For example, a flashlight can quickly replace a laser pointer. It further allows a shooter to use an existing iron sight at a front of a gun by providing a window for viewing the iron sight.

Inasmuch as only several embodiments have been illustrated and described, it is obvious that other embodiments can be derived by changes that are well known by persons skilled in the art, such as changes in shape, inversion of parts and addition of parts, which fall within the scope of our invention and the spirit thereof.

What we claim is new is:

1. A single mount for mounting an accessory at optional positions on a bracket relative to a hand gun, said mount comprising: a bracket surrounding a barrel of said hand gun, said bracket mounted on Picatinny type rail of a hand gun and an accessory mounted on said bracket above, below or at a side of said hand gun, said bracket having an upper portion for attaching an accessory above a top of said hand gun at a distance which allows a shooter to view an iron sight of said hand gun, a lower portion for attaching said bracket to said Picatinny type rail of said hand gun, and a pair of slender side portions for connecting said upper and said lower portions, said lower portion having a pair of V-grooves for slideably engaging said Picatinny type rail of said hand gun and at least one short Picatinny type rail portion extending outward from said bracket for attaching a second accessory.

2. The single mount recited in claim 1 wherein said accessory that is attached to said upper portion is a telescope.

3. The single mount recited in claim 1 further comprising a second outward extending short Picatinny type rail portion for attaching said second accessory.

4. The single mount recited in claim 1 wherein said short Picatinny type rail portion extends outwardly from one of said slender side portions of said bracket.

5. The single mount recited in claim 1 wherein said short Picatinny type rail portion extends downwardly from said lower portion.

6. The single mount recited in claim 2 wherein a short Picatinny type rail portion extends from said upper portion for attaching said telescope.

7. The single mount recited in claim 1 wherein said short Picatinny type rail portion extends outwardly from a side of said upper portion.

8. The single mount recited in claim 7 further comprising a second short Picatinny type rail portion extending outwardly from an opposite side of said upper portion.

9. The single mount recited in claim 4 further comprising a second short Picatinny type rail portion extending outwardly from an opposite slender side portion.

10. The single mount recited in claim 1 wherein said upper portion for attaching a telescope accessory is an accessory ring.

11. The single mount recited in claim 10 wherein said accessory ring is comprised of a lower saddle portion and an upper detachable cap portion.

12. A single mount for mounting multiple accessories on bracket attached to a Picatinny type rail of a hand gun, said mount comprising: said bracket slideably engaging said Picatinny type rail and an accessory above, below and to a side of said hand gun, said bracket having an upper portion for attaching a telescopic sight above said hand gun at a distance which allows a shooter to view an iron sight of said hand gun, a lower portion for attaching said bracket to said Picatinny rail of said hand gun, and a pair of slender side portions for connecting said upper with said lower portion, said lower portion having a pair of V-grooves for slideably engaging said Picatinny type rail of said gun and at least one short outward extending Picatinny type rail portion extending downwardly from said lower portion for attaching a flashlight.

13. A single mount for mounting accessories on a hand gun, said mount comprising: a bracket for mounting an accessory above, below or to a side of said hand gun, said bracket having an upper portion for attaching a laser pointer above said hand gun at a distance which allows a shooter to view an iron sight of said hand gun, a lower portion for slideably engaging said mount with a Picatinny type rail of said hand gun, said lower portion having a pair of V-grooves for slideably engaging said bracket with said Picatinny type rail and a pair of short outward extending Picatinny type rail portions extending outwardly from opposite sides of said bracket for mounting accessories.

14. The single mount recited in claim 10 wherein said accessories are a telescopic sight and a laser pointer.

15. The single mount recited in claim 14 wherein said telescopic sight is mounted above a barrel of said hand gun and said laser pointer is mounted on said bracket below said barrel of said hand gun.

16. The single mount recited in claim 14 wherein said telescopic sight and said laser pointer are mounted at opposite sides of said bracket above a barrel of said hand gun.

17. The single mount recited in claim 15 further comprising an accessory ring extending downwardly from said lower portion for attaching an accessory.

* * * * *